United States Patent [19]

Höglund et al.

[11] Patent Number: 4,991,720

[45] Date of Patent: Feb. 12, 1991

[54] APPARATUS FOR DIVIDING A SUSPENSION OF FIBROUS CELLULOSE PULP

[75] Inventors: Ronny Höglund, Skoghall; Lars Jacobsson, Karlstad, both of Sweden

[73] Assignee: Kamyr AB, Karlstad, Sweden

[21] Appl. No.: 434,474

[22] Filed: Nov. 14, 1989

Related U.S. Application Data

[63] Continuation of Ser. No. 207,214, Jun. 16, 1988, abandoned.

[30] Foreign Application Priority Data

Jul. 3, 1987 [SE] Sweden ..... 8702744

[51] Int. Cl.[5] ..... B03B 7/00; B07B 9/00

[52] U.S. Cl. ..... 209/12; 209/234; 209/273; 241/46.17

[58] Field of Search ..... 209/270, 273, 234, 268, 209/271, 12; 241/46.17, 69, 79.1; 162/55, 261

[56] References Cited

U.S. PATENT DOCUMENTS

| | | | |
|---|---|---|---|
| 1,537,691 | 5/1925 | Priem | 209/273 |
| 2,682,811 | 7/1954 | Infanger | 209/273 |
| 4,231,881 | 11/1980 | Ingemarsson | 210/396 |
| 4,303,508 | 12/1981 | Skretting | 209/297 |
| 4,680,108 | 7/1987 | Ahs | 209/273 |
| 4,737,274 | 4/1988 | Jacobsen et al. | 209/268 |

FOREIGN PATENT DOCUMENTS

| | | | |
|---|---|---|---|
| 2479296 | 10/1981 | France | 162/261 |
| 0032594 | 8/1984 | Japan | 209/273 |

*Primary Examiner*—Donald T. Hajec

*Attorney, Agent, or Firm*—Nixon & Vanderhye

[57] ABSTRACT

In an apparatus for dividing a suspension of fibrous cellulose pulp into a plurality of portions in a closed housing having multiple inlets and outlets, the present invention suggests that the closed housing is divided into two chambers, each provided with at least one inlet and at least one outlet, and that in the first chamber a separating device is arranged, rotating at high speed, to separate undesired parts from the suspension via an outlet, the inlet of the second chamber comprising an opening arranged between the first chamber and the second chamber to transfer the suspension which has been substantially freed from undesired parts. Furthermore in the second chamber a rotor provided with blades is arranged, the rotor being connected to the separating device in the first chamber, the separating device and rotor being driven by a common shaft, and a screening device cooperating with the rotor, to divide the suspension into different fractions which leave the second chamber by individual outlets.

5 Claims, 1 Drawing Sheet

APPARATUS FOR DIVIDING A SUSPENSION OF FIBROUS CELLULOSE PULP

This is a continuation of application Ser. No. 07/207,214, filed June 16, 1988, now abandoned.

FIELD AND BACKGROUND OF THE INVENTION

The present invention relates to an apparatus for dividing a suspension of fibrous cellulose pulp into a plurality of portions in a closed housing having inlet and outlet means.

In the production of fibrous cellulose pulp impurities are supplied from outside as well as through deficiencies during the actual manufacturing process. These undesired parts may vary in size and consist for instance of sand particles, gravel, stones, nuts, parts of welding electrodes and pieces of metal. It is therefore necessary to remove such undesired parts, especially from suspensions which are to be processed further in machines and equipments which are sensitive and may be damaged by such solid parts, or which for other reasons must as far as possible be freed from impurities. Various types of devices have been suggested for separating undesired solid parts from a fibrous cellulose pulp, see e.g. Pat. specifications No. SE 7903032-6 (corresponding to U.S. Pat. No. 4,303,508), SE 8503372-8 (corresponding to U.S. Pat. application No. 882,716) and U.S. Pat. No. 4,231,881.

In order to be able to subject a fibrous cellulose pulp of medium concentration, i.e. about 6–15%, a screening operation, a screening device must be used which generates pulsations and shearing forces in the pulp so that it is fluidized, i.e. it is transferred to an easy flowing condition, and the fibres can then move in relation to each other. A part-flow of finer fibrous material (accept) and a part-flow of coarser material (reject) can thus be obtained through screening. A screening device based on the above principle is described in SE 8501030-4 (corresponding to U.S. Pat. application No. 836 123).

SUMMARY OF THE INVENTION

The object of the present invention is to provide an apparatus which forms a compact, multi-functional construction unit for the continuous separation of undesired parts of the type specified and also the division of the suspension into a fine fraction (accept) and a coarse fraction (reject). Furthermore, the apparatus provides improved screening effect in comparison with a screening device of known type as described above. It is also an important object of the invention to provide a multi-functional apparatus which, in comparison with the combined use of two separate apparatus, each with its own function (separation and screening, respectively), simplifies driving and the driver equipment, simplifies installation and reduces control, regulation and safety equipments, with a consequent reduction in operation, installation and apparatus costs.

The above objects are achieved according to the present invention in that the closed housing is divided into two chambers, each provided with inlet and outlet means, that in the first chamber a separating means is arranged, rotating at high speed, to separate undesired parts from the suspension via an outlet, that an opening is arranged between the first chamber and the second chamber to transfer the suspension which has been substantially freed from undesired parts, and that in the second chamber a rotor means provided with blades is arranged, said rotor means being connected to the separating means in the first chamber, the separating means and rotor means being driven by a common shaft, and a screening means cooperating with the rotor means, to divide the suspension into different fractions which leave the second chamber by individual outlets. The different fractions may consist of a finer fraction (accept) and a coarser fraction (reject).

BRIEF DESCRIPTION OF THE DRAWINGS

A preferred embodiment of the invention will be described further with reference to the accompanying drawing.

DETAILED DESCRIPTION OF THE DRAWINGS

Figure 1:
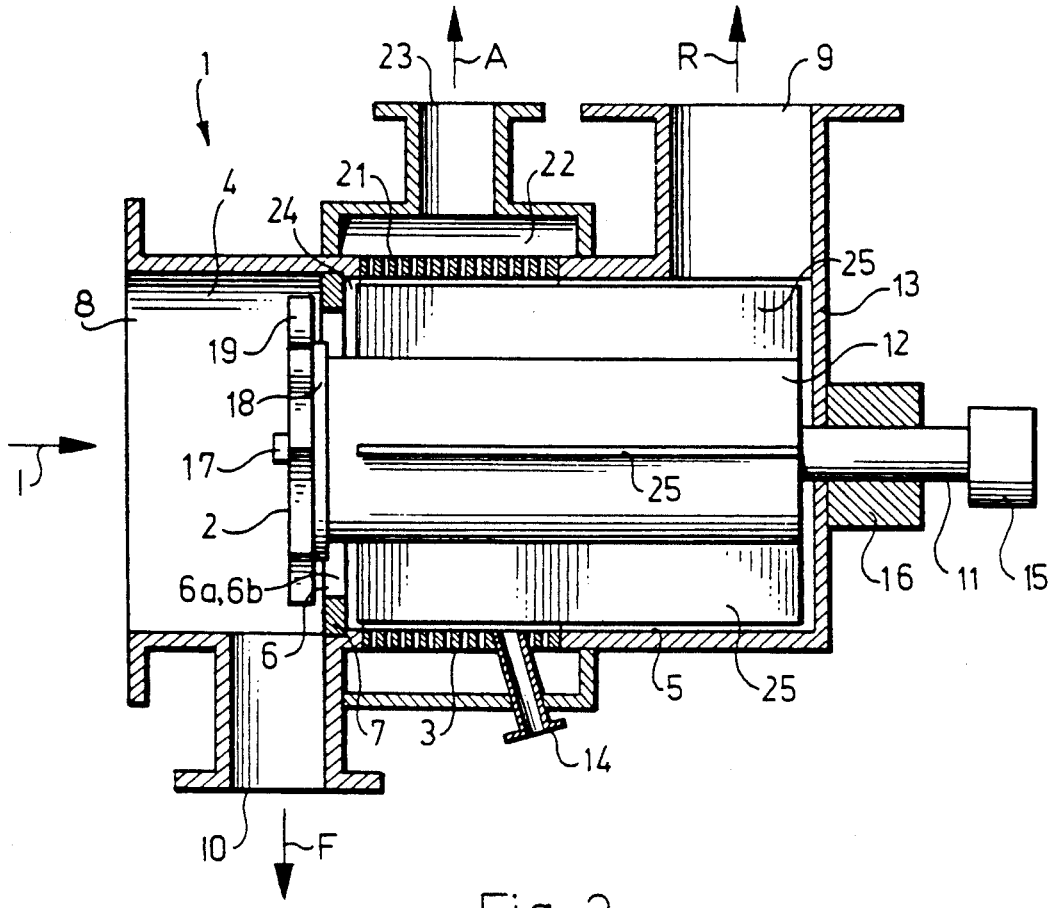
FIG. 1 shows schematically an apparatus according to the present invention in longitudinal section.

The apparatus shown schematically in FIG. 1 comprises a housing 1 which is common to both a separating means 2 for separating undesired solid parts or particles from a suspension of fibrous cellulose pulp, and a screening means 3 for screening the suspension. The housing 1 is divided into a first chamber 4 for the separating means 2 and a second chamber 5 for, inter alia, the screening means 3, the chambers 4 and 5 communicating with each other via an opening in the form of an annular slot 6 of predetermined size. A ring 7 rigidly attached in the housing 1 thus forms the boundary between the two chambers 4 and 5, the inner circumference of the ring 7 thus forming the outer circumference of the annular slot 6.

The housing 1 is provided with an inlet 8 to the first chamber 4, for the suspension I to be treated (inject), and an outlet 9 from the second chamber 5, for the material R remaining after screening (reject). In the embodiment shown the inject inlet 8 is arranged axially in relation to the separating means 2. Alternatively it may be arranged radially or tangentially on the cylindrical housing. Furthermore, the housing 1 is provided with an outlet 10 from the chamber 4, for undesired parts which may be designated solid impurities F. The annular slot 6 forms an outlet **6*a* from the first chamber 4 and a corresponding inlet 6*b* to the second chamber 5**.

Further, the apparatus comprises a horizontal, rotatable shaft 11 carrying said separating means 2 and also a rotor 12 located in the second chamber 5, the shaft 11 extending through an end wall 13 of the housing 1, opposite to the inject inlet 8. The shaft 11 thus extends through the second chamber 5 and centrally through said ring 7. The shaft 11, with associated rotor 12 and separating means 2, is driven by a motor 15, shown schematically and supported by a bearing unit 16, also shown schematically, provided with suitable sealing means at the end wall 13 to seal between the housing and the shaft. The separating means 2 is rigidly secured to the inner end portion of the shaft 11 by a suitable securing device 17, a flat, circular disc 18 being arranged on the shaft 11 inside the separating means 2, between this and the rotor 12. The outer circumference of the disc 18 forms the inner circumference of said annular slot 6. In other words, the annular slot 6 is defined outwardly by the ring 7 and inwardly by the circular disc 18. Alternatively the disc 18 may be replaced by a corresponding extension of the rotor and corresponding broadening or enlargement of the rotor (appearing similar to the disc 18), at least of the end portion in question.

Figure 2:
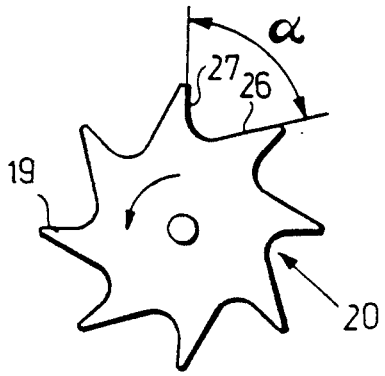
FIG. 2 shows a suitable embodiment of a toothed disc element mounted in the apparatus.

The separating means 2 consists of a flat disc element having a plurality of projections in the form of teeth, cogs or the like extending substantially radially (see FIG. 2, said teeth and the spaces 20 defined between them to allow the suspension through during rotation of the disc element 2, are axially aligned with the annular slot 6. The radial extension of the slot 6 is slightly less than, and lies within, the radial extension of the teeth 19, i.e. a circle drawn through the top of the teeth 19 with the shaft 11 as its centre, suitably has a diameter slightly larger than the inner diameter of the ring 7 (corresponding to the diameter of the ring opening), and a circle drawn through the base of the teeth 19 has a diameter which is suitably slightly less than the diameter of the disc 18. The disc element 2 is mounted as close to the ring 7 as possible so that the outlet available for the flow of the suspension to the second chamber 5 will be formed mainly by the rotating spaces 20 between the teeth 19. The distance between the disc element 2 and the ring 7 is generally less than is shown in the drawing. Said outlet 10 for solid parts which are hit by the rotating teeth 19 and thus removed from the suspension, is located in the plane of the disc element 2 and on the lower side of the housing 1.

A suitable embodiment of a toothed disc element 2 is shown in FIG. 2 where the direction of rotation is indicated by an arrow. The foremost edge 26 of a tooth 19 seen in the direction of rotation, forms an angle $\alpha$ with the rear edge 27 of the tooth immediately in front, which is suitably radial. The angle $\alpha$ may suitably be from 60° to 75° so that during its rotation in the direction of the arrow, the disc element 2 throws the undesired solid parts outwards and obliquely backwards, these impurities thus being prevented from passing axially or transversely through the disc element 2. The separated impurities may also include knots or largish pieces of wood. However, the main portion of these naturally occurring impurities will accompany the final reject.

The outlet 10 for the solid parts is connected to a suitable device (not shown) for collecting and removing the solid parts separated from the suspension. Liquid, normally water, may be supplied to this device in order to create a small counterflow of liquid through the device so that it is not filled with fibres from the suspension, but will contain substantially the undesired solid parts removed therefrom.

The screening means 3, is arranged in the vicinity of the ring 7 and consists in the embodiment shown of a cylindrical wall having a forward screened portion and a rearward solid portion which together define the second chamber 5. The forward screened portion includes a cylindrical screening plate 21 provided with suitable openings in the form of holes or slots to screen off a finer fraction, known as the accept A. The screening plate 21 is surrounded by an annular accept chamber 22 to collect the accept screened off, which is then removed via an accept outlet 23 located radially outwardly of the cylindrical wall. Arranging the annular slot 6 in line with the space 24 ensures a uniform distribution of suspension around the screening plate 21. According to a modified embodiment (not shown), the screening plate has limited circumferential extension, e.g 180°.

It is recognized that the rotor 12 has a smaller diameter than the screening cylinder 21 so that a sufficient annular space 24 is formed therebetween to receive the suspension from which undesired parts have been removed. Moreover, the space 24 is sufficiently large in radial direction to contain a plurality of blades 25 attached to the rotor 12 and extending substantially axially along it. The blades 25 are directed radially to pass along the inner cylindrical screening surface of the screening plate 21, and thus at a suitable small distance therefrom, during rotation of the rotor. In the region of the reject outlet 9, arranged close to the end wall 13 and thus at a distance from the annular slot 6, the blades may have greater radial extension than in the region of the screening cylinder 21 in order to achieve increased discharge effect at the outlet 9 if desired and the housing 1 is in this case correspondingly enlarged in radial direction near the end wall 13 to provide space for the wider blades. In the embodiment shown there are four blades 25 but the number may vary depending on the capacity of the apparatus, the screening properties of the suspension, etc. Alternatively the blades may be inclined in suitable manner, to extend helically along the rotor. They are then preferably so directed as to give the suspension a favourable feed effect.

The apparatus is also preferably provided with an inlet means 14 for the supply of diluting liquid to the second chamber 5, i.e. to the inject side of the screening cylinder 21, with the object of washing fibres away from the reject so that as little useful fibres as possible accompanies the reject and is instead caused to pass through the screening cylinder as accept. In the embodiment shown the inlet means 14 is a pipe connection extending through the accept chamber 22 and screening cylinder 21 and to the inside of the screening cylinder close to the downstream end thereof and thus spaced from the upstream end located closest to the ring 7. The pipe connection is suitably inclined as shown and is arranged substantially diametrically opposite the accept outlet 23. Alternatively several pipe connections may be distributed around the inject side of the screening cylinder.

The apparatus according to the invention can consequently be termed as a multi-functional construction unit due to the fact that in one and the same housing, and utilizing the safe drive source and drive shaft, it is possible to perform continuous separation of impurities and, immediately thereafter, a continuous division of the suspension into at least one accept flow and one reject flow.

The suspension I flowing into the apparatus under pressure, is forced outwardly to the annular slot 6 in order to pass through it, the cross section area of the inject inlet 8 being considerably greater than the cross section area of the annular slot 6, so that the suspension is forced to accelerate to a higher speed while at the same time fluidizing. This is particularly important when the fibre pulp is of medium concentration. As the disc element 2 rotates in front of the slot 6, its teeth 19 will generate shearing forces in the suspension so that it becomes fluidized, i.e. easy flowing. Since the disc element 2 is located close to the annular slot 6 the suspension will enter the second chamber in fluidized form. This fluidized form is then maintained and improved by the rotor provided with blades. The apparatus thus provides an improved fluidization effect, which in turn increases the screening effect and reduces the power demand.

During rotation of the rotor 12 the blades 25 will create pressure pulses in the suspension which, besides having a fluidizing effect also have a cleaning effect on the screening plate 21, keeping the openings clear. During operation the apparatus is completely filled with pulp suspension flowing through the two chambers 4, 5 under pressure.

Other essential advantages of the multi-functional apparatus according to the invention are that the power demand for the operation is considerably reduced since the drive means 15 is the same for both the rotor 12 provided with blades 25 and the toothed disc element 2. Further, installation is simplified and space saved in the process plant. Similarly, the equipments for control and regulation as well as safety systems are reduced considerably. These improvements in turn result in considerable reduction of the operation, installation and material costs.

In an alternative embodiment (not shown) the shaft 11 is extended and passes through the entire housing, being journalled in a second bearing unit at the other side of the housing (to the left in FIG. 1). This side is then provided with an end wall, and the inject inlet for the suspension is located at the side of the housing instead of at its end as described above.

The apparatus is particularly suitable for assembly in a closed pressure system, e.g. in the blow pipe from a continuous pulp digester, to remove particles which may damage subsequent process machines. The fine fraction or accept flow thus obtained may then be conveyed for oxygen bleaching, for instance. The apparatus can thus be designed for use at any pressure above atmospheric generally occurring. A suitable speed for the toothed disc element and the rotor shaft is about 1500 rpm for a pulp of medium concentration.

In another embodiment not shown of the invention the elongate rotor is replaced by a disc rotor, provided with corresponding blades on the flat side facing the first chamber. The second chamber is then enlarged diametrically and shortened axially to agree with the shape of the disc rotor. The disc rotor provided with blades then cooperates with a circularly flat screening means.

That which is claimed is:

1. An apparatus for dividing a suspension of fibrous cellulose pulp into a plurality of portions comprising a closed housing divided into two chambers, a first forward chamber including an inlet and an outlet, and a second rearward chamber including at least a pair of outlets; said chambers being separated by an open, annular slot defined by inner and outer diameters; a rotor located substantially in said second chamber, with an impeller mounted thereon projecting into said first chamber in close proximity to said slot, and wherein said rotor defines the inner diameter of said slot; said impeller serving to separate undersized parts from the suspension in said first chamber, and to fluidize remaining suspension as it enters the second chamber; said second chamber defined by a cylindrical wall having a forward screened portion and a rearward solid portion and said rotor having a plurality of blades mounted thereon and extending axially substantially coextensively with said screened and solid portions of said second chamber; one of said pair of outlets of said second chamber located radially outwardly of said cylindrical wall and adjacent said screened portion of said second chamber, the other of said pair of outlets of said second chamber extending from said solid portion of said second chamber.

2. An apparatus as claimed in claim 1 wherein said forward screened portion includes a cylindrical screen plate provided with openings and an accept chamber located therebehind, the blades of the rotor means passing along the screen plate during rotation of the rotor means.

3. An apparatus as claimed in claim 1 and wherein said apparatus is provided with inlet means for the supply of diluting liquid to an injection side of the forward screened portion.

4. The apparatus according to claim 1 wherein said rotor has an outer diameter substantially less than an outer diameter of said open, annular slot.

5. The apparatus according to claim 4 wherein said blades extend radially from said rotor to a location closely adjacent said cylindrical wall to thereby bridge the inner and outer diameters of said slot.

* * * * *